US012232668B2

(12) United States Patent
Byhower

(10) Patent No.: US 12,232,668 B2
(45) Date of Patent: Feb. 25, 2025

(54) HAND WASHING ASSEMBLY

(71) Applicant: Lexx Byhower, Redondo Beach, CA (US)

(72) Inventor: Lexx Byhower, Redondo Beach, CA (US)

( * ) Notice: Subject to any disclaimer, the term of this patent is extended or adjusted under 35 U.S.C. 154(b) by 263 days.

(21) Appl. No.: 17/967,292

(22) Filed: Oct. 17, 2022

(65) Prior Publication Data

US 2024/0122415 A1 Apr. 18, 2024

(51) Int. Cl.

| | |
|---|---|
| ***A47K 7/02*** | (2006.01) |
| ***A46B 1/00*** | (2006.01) |
| ***A46B 5/02*** | (2006.01) |
| ***A46B 11/00*** | (2006.01) |
| ***A47K 7/03*** | (2006.01) |

(52) U.S. Cl.

CPC ..... *A47K 7/03* (2013.01); *A46B 1/00* (2013.01); *A46B 5/02* (2013.01); *A46B 11/0072* (2013.01); *A46B 2200/1006* (2013.01)

(58) Field of Classification Search

CPC . A47K 7/02; A47K 7/028; A47K 7/03; A46B 11/0072; A46B 5/02

See application file for complete search history.

(56) References Cited

U.S. PATENT DOCUMENTS

| | | | | | |
|---|---|---|---|---|---|
| 3,066,346 | A * | 12/1962 | Hofstra | A46B 9/02 | 401/184 |
| 4,457,640 | A * | 7/1984 | Anderson | A47K 7/03 | 15/104.94 |
| 4,730,949 | A * | 3/1988 | Wilson | A46B 11/001 | 604/3 |
| 5,496,026 | A * | 3/1996 | Montgomery | A63B 43/002 | 473/600 |
| 6,109,214 | A * | 8/2000 | Rampersad | A46B 5/04 | 401/7 |
| D478,681 | S | 8/2003 | Newcomb | | |
| 8,015,654 | B2 | 9/2011 | Faiola | | |
| 8,595,887 | B2 | 12/2013 | Hiltmann | | |
| D896,457 | S | 9/2020 | Shamoon | | |
| 10,893,744 | B2 | 1/2021 | Lopiccolo | | |
| 2002/0002984 | A1 | 1/2002 | Loy | | |
| 2005/0265772 | A1* | 12/2005 | Antoine | A47K 7/03 | 401/201 |
| 2005/0282716 | A1* | 12/2005 | Papernik | A47K 7/03 | 510/141 |

(Continued)

FOREIGN PATENT DOCUMENTS

| | | | | |
|---|---|---|---|---|
| CA | 2491170 | A1 * | 6/2006 | A46B 11/0013 |
| CN | 104799560 | A * | 7/2015 | |

(Continued)

*Primary Examiner* — Michael D Jennings

(57) ABSTRACT

A hand washing assembly for scrubbing a user's hands includes a shell that is foraminous thereby facilitating a fluid to pass through the shell. The shell is elongated such that the shell has an egg shape thereby facilitating the shell to fit into a palm of a user's hand. A plurality of bristles is each coupled to and extends outwardly from the shell thereby facilitating the plurality of bristles to scrub the user's hand. A sponge is insertable into the shell and the sponge is comprised of a fluid absorbent material thereby facilitating the sponge to absorb a liquid soap. The sponge releases the liquid soap outwardly through the shell to enhance cleaning the user's hands.

6 Claims, 5 Drawing Sheets

(56) References Cited

U.S. PATENT DOCUMENTS

| | | | | |
|---|---|---|---|---|
| 2006/0288954 | A1* | 12/2006 | Graunstadt | A01K 13/001 119/652 |
| 2010/0130988 | A1* | 5/2010 | Bolton | A47K 7/03 132/200 |
| 2010/0147892 | A1* | 6/2010 | LaFlamme | G01F 11/025 222/207 |
| 2011/0052306 | A1* | 3/2011 | Cavaiani | A46B 11/0079 222/105 |
| 2018/0153355 | A1* | 6/2018 | Avshalom | A47K 7/03 |
| 2021/0251435 | A1* | 8/2021 | Muthusamy | A47K 5/1201 |
| 2021/0282603 | A1* | 9/2021 | Lin | A47K 5/04 |
| 2022/0151442 | A1* | 5/2022 | Gorena Jean | A47K 7/02 |

FOREIGN PATENT DOCUMENTS

| | | | | |
|---|---|---|---|---|
| CN | 207666219 | U | * | 7/2018 |
| CN | 208850767 | U | * | 5/2019 |
| CN | 208863680 | U | * | 5/2019 |
| WO | WO2009149569 | | | 12/2009 |

* cited by examiner

HAND WASHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to washing devices and more particularly pertains to a new washing device for scrubbing a user's hands. The device includes an egg shaped shell that is foraminous and a plurality of bristles attached to the shell. The device includes a sponge that is positioned inside the shell and which is soaked with a liquid soap that is released through the shell to facilitate a user to scrub their hands with the shell and bristles.

(2) Description of Related Art Including Information Disclosed Under 37 CFR 1.97 and 1.98

The prior art relates to washing devices including a surgical scrub brush device that includes radial bristles and a curved gripping surface. The prior art discloses an egg shaped ball being comprised of an elastomeric material for bouncing and catching the egg shaped ball. The prior art discloses a variety of scrubbing devices that each at least includes a planar scrubbing surface and a plurality of bristles disposed on the planar scrubbing surface. The prior art discloses an ornamental design of a decorative egg which includes an upper half being removably attached to a lower half, a channel extending through the decorative egg and a glow stick being insertable into the channel.

BRIEF SUMMARY OF THE INVENTION

An embodiment of the disclosure meets the needs presented above by generally comprising a shell that is foraminous thereby facilitating a fluid to pass through the shell. The shell is elongated such that the shell has an egg shape thereby facilitating the shell to fit into a palm of a user's hand. A plurality of bristles is each coupled to and extends outwardly from the shell thereby facilitating the plurality of bristles to scrub the user's hand. A sponge is insertable into the shell and the sponge is comprised of a fluid absorbent material thereby facilitating the sponge to absorb a liquid soap. The sponge releases the liquid soap outwardly through the shell to enhance cleaning the user's hands.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
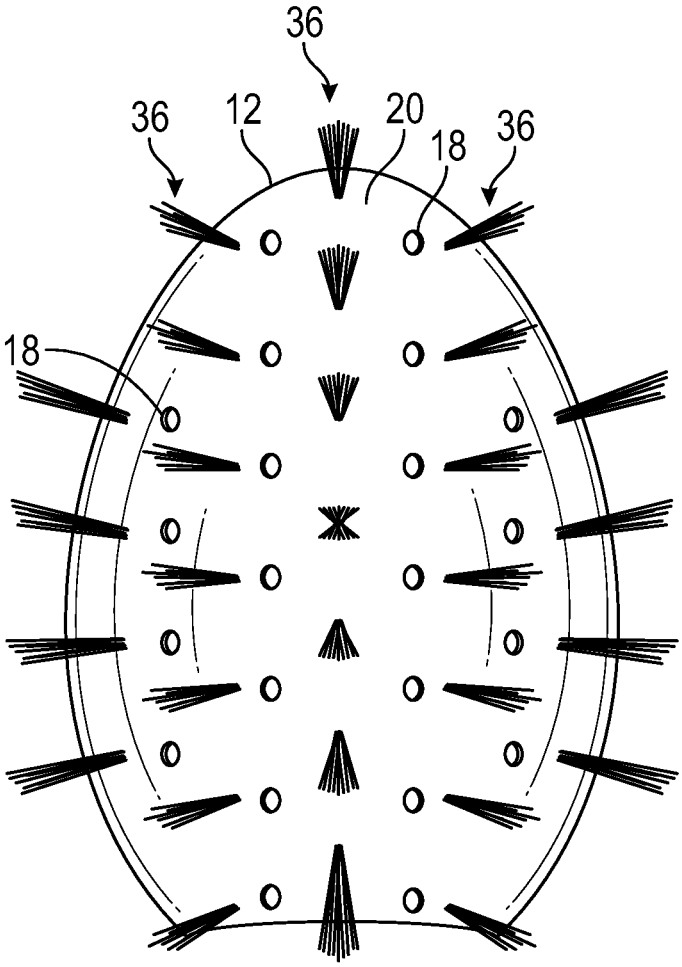
FIG. 1 is a front view of a hand washing assembly according to an embodiment of the disclosure.
Figure 2:
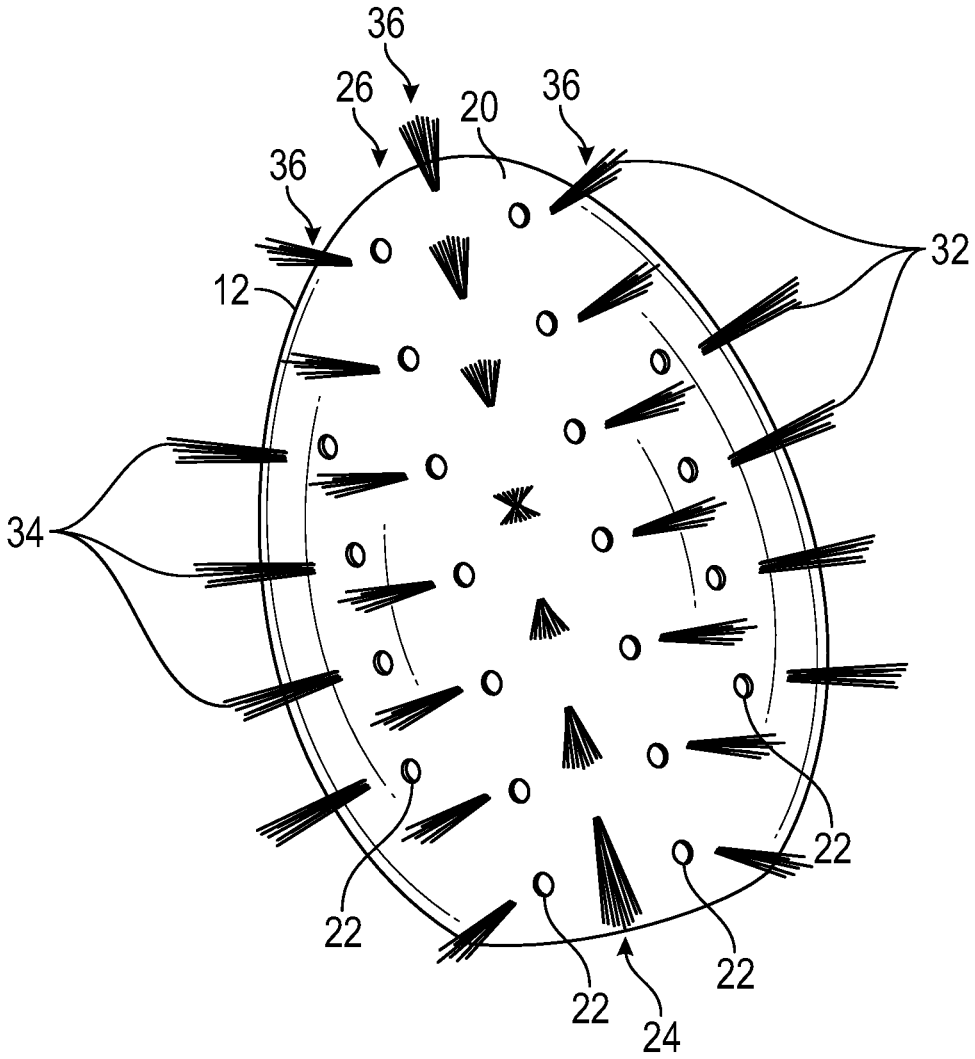
FIG. 2 is a back view of an embodiment of the disclosure.
Figure 3:
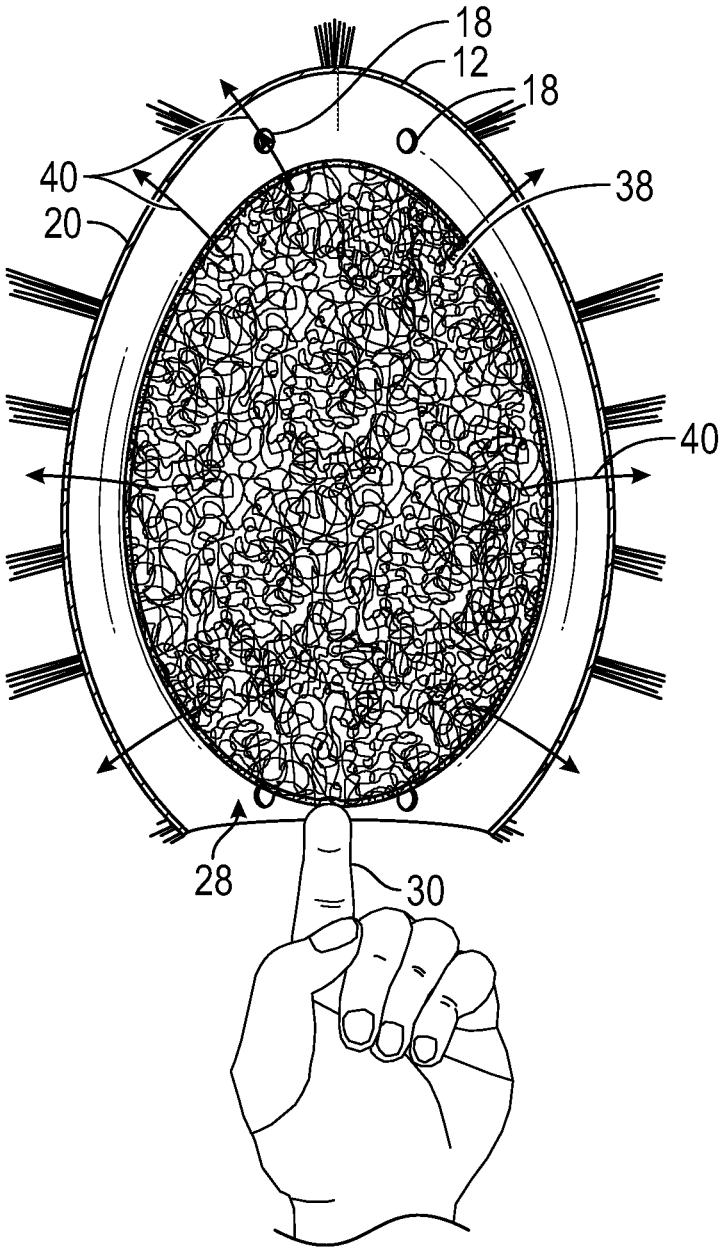
FIG. 3 is a front cut-away view of an embodiment of the disclosure showing a user's finger being inserted into a finger opening.
Figure 4:
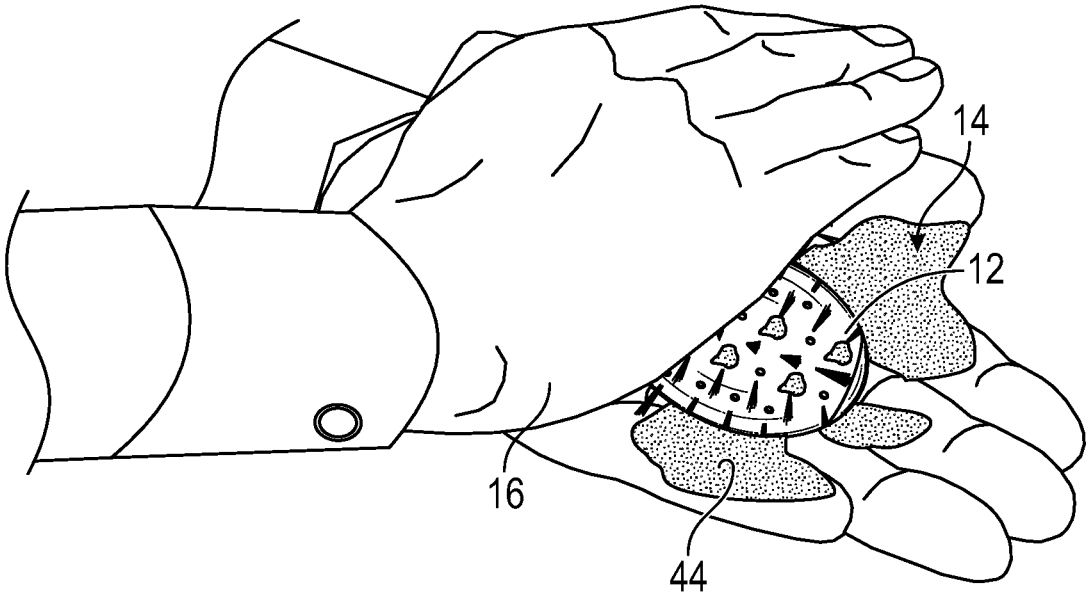
FIG. 4 is a perspective in-use view of an embodiment of the disclosure.
Figure 5:
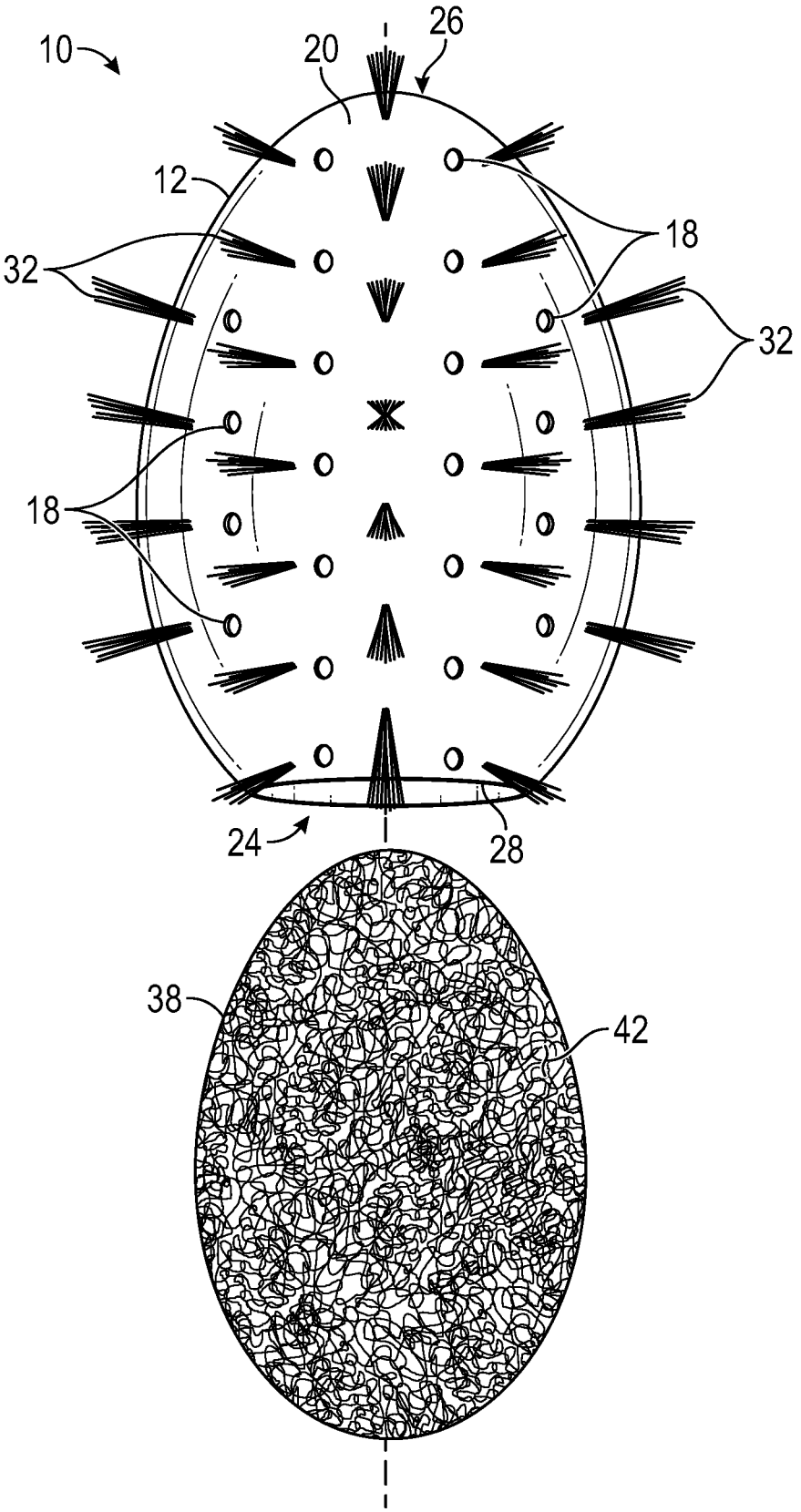
FIG. 5 is an exploded perspective view of an embodiment of the disclosure.

With reference now to the drawings, and in particular to FIGS. 1 through 5 thereof, a new washing device embodying the principles and concepts of an embodiment of the disclosure and generally designated by the reference numeral 10 will be described.

As best illustrated in FIGS. 1 through 5, the hand washing assembly 10 generally comprises a shell 12 that is foraminous thereby facilitating a fluid to pass through the shell 12. The shell 12 is comprised of a rigid material, including but not being limited to plastic or aluminum. The shell 12 is elongated such that the shell 12 has an egg shape thereby facilitating the shell 12 to fit into a palm 14 of a user's hand 16. The shell 12 has plurality of openings 18 each extending through an outer wall 20 of the shell 12 thereby facilitating the shell 12 to be foraminous. The openings 18 are spaced apart from each other and are distributed over a substantial area of the outer wall 20. Furthermore, the openings 18 are arranged into a plurality of rows 22 each extending between a lower apex 24 and an upper apex 26 of the egg shape defined by the shell 12. The rows 22 are spaced apart from each other and are evenly distributed around a full circumference of the outer wall 20.

The shell 12 has a finger hole 28 extending through the outer wall 20 thereby facilitating a user's finger 30 to extend through the finger hole 28. The finger hole 28 is aligned with the lower apex 24 of the egg shape defined by the shell 12. A plurality of bristles 32 is each coupled to and extends outwardly from the shell 12 thereby facilitating the plurality of bristles 32 to scrub the user's hand 16. The bristles 32 are arranged into a plurality of sets of bristles 34 and the plurality of sets of bristles 34 is arranged into a plurality of rows of bristles 36. Each of the rows of bristles 36 is positioned between a respective pair of rows 22 of the openings 18 in the outer wall 20 of the shell 12. Additionally, each of the rows of bristles 36 extends between the upper apex 26 of the egg shaped defined by the shell 12 and the finger hole 28.

A sponge 38 is insertable into the shell 12 and the sponge 38 is comprised of a fluid absorbent material thereby facilitating the sponge 38 to absorb a liquid soap 40. The sponge 38 releases the liquid soap 40 outwardly through the shell 12 to enhance cleaning the user's hands 16. The sponge 38 is insertable through the finger hole 28 in the outer wall 20 of the shell 12 and the sponge 38 is compressible by the user's finger 30 when the user's finger 30 is extended through the finger hole 28. In this way the liquid soap 40 can be squeezed out of the sponge 38 and urged outwardly through each of the openings 18 in the outer wall 20 of the shell 12. The sponge 38 has an outer surface 42 and the outer surface 42 is continuously arcuate about a center axis of the sponge 38 such that the sponge 38 has a rounded shape. The sponge 38 is elongated along the center axis such that the sponge 38 has an ovoid shape thereby facilitating the outer surface 42 to conform to the outer wall 20 of the shell 12 when the sponge 38 is positioned in the shell 12.

In use, liquid soap 40 is poured through the finger hole 28 to be absorbed by the sponge 38 and water is subsequently poured though the finger hole 28. The user's finger 30 is inserted into the finger hole 28 to compress the sponge 38 and urge soap suds 44 outwardly through the openings 18 in the shell 12. In this way the shell 12 releases the soap suds 44 onto the user's hands 16 as the shell 12 being scrubbed in the user's hands 16. Thus, the bristles 32 scrub the user's hands 16 with the soap suds 44 to thoroughly clean the user's hands 16 of grease, oil, dirt and other compounds that can be difficult to clean from a person's hands.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hand washing assembly for washing a user's hands, said assembly comprising:

a shell being foraminous thereby facilitating a fluid to pass through said shell, said shell being elongated such that said shell has an egg shape thereby facilitating said shell to fit into a palm of a user's hand;

a plurality of bristles, each of said bristles being coupled to and extending outwardly from said shell thereby facilitating said plurality of bristles to scrub the user's hand; and a sponge being insertable into said shell, said sponge being comprised of a fluid absorbent material thereby facilitating said sponge to absorb a liquid soap, said sponge releasing the liquid soap outwardly through said shell to enhance cleaning the user's hands;

wherein said shell has plurality of openings each extending through an outer wall of said shell thereby facilitating said shell to be foraminous, said openings being spaced apart from each other, said openings being distributed over said outer wall, said openings being arranged into a plurality of rows, each of said each extending between a lower apex and an upper apex of said egg shape defined by said shell, said rows being spaced apart from each other, said openings being evenly spaced around a full circumference of said outer wall.

2. The assembly according to claim 1, wherein said shell has a finger hole extending through said outer wall thereby facilitating a user's finger to extend through said finger hole, said finger hole being aligned with said lower apex of said egg shape defined by said shell.

3. The assembly according to claim 2, wherein said bristles are arranged into a plurality of sets of bristles, said plurality of sets of bristles being arranged into a plurality of rows of bristles, each of said rows of bristles being positioned between a respective pair of rows of said openings in said outer wall of said shell, each of said rows of bristles extending between said upper apex of said egg shaped defined by said shell and said finger hole.

4. The assembly according to claim 2, wherein said sponge is insertable through said finger hole in said outer wall of said shell, said sponge being compressible by the user's finger when the user's finger is extended through said finger hole thereby facilitating the liquid soap to be urged outwardly through each of said openings in said outer wall of said shell.

5. The assembly according to claim 4, wherein said sponge has an outer surface, said outer surface being continuously arcuate about a center axis of said sponge such that said sponge has a rounded shape, said sponge being elongated along said center axis such that said sponge has an ovoid shape thereby facilitating said outer surface to conform to said outer wall of said shell when said sponge is positioned in said shell.

6. A hand washing assembly for washing a user's hands, said assembly comprising:

a shell being foraminous thereby facilitating a fluid to pass through said shell, said shell being elongated such that said shell has an egg shape thereby facilitating said shell to fit into a palm of a user's hand, said shell having plurality of openings each extending through an outer wall of said shell thereby facilitating said shell to be foraminous, said openings being spaced apart from each other, said openings being distributed over said outer wall, said openings being arranged into a plurality of rows each extending between a lower apex and an upper apex of said egg shape defined by said shell, said rows being spaced apart from each other, said openings being evenly spaced around a full circumference of said outer wall, said shell having a finger hole extending through said outer wall thereby facilitating a user's finger to extend through said finger hole, said finger hole being aligned with said lower apex of said egg shape defined by said shell;

a plurality of bristles, each of said bristles being coupled to and extending outwardly from said shell thereby facilitating said plurality of bristles to scrub the user's hand, said bristles being arranged into a plurality of sets of bristles, said plurality of sets of bristles being arranged into a plurality of rows of bristles, each of said rows of bristles being positioned between a respective pair of rows of said openings in said outer wall of said shell, each of said rows of bristles extending between said upper apex of said egg shaped defined by said shell and said finger hole; and a sponge being insertable into said shell, said sponge being comprised of a fluid absorbent material thereby facilitating said sponge to absorb a liquid soap, said sponge releasing the liquid soap outwardly through said shell to enhance cleaning the user's hands, said sponge being insertable through said finger hole in said outer wall of said shell, said sponge being compressible by the user's finger when the user's finger is extended through said finger hole thereby facilitating the liquid soap to be urged outwardly through each of said openings in said outer wall of said shell, said sponge having an outer surface, said outer surface being continuously arcuate about a center axis of said sponge such that said sponge has a rounded shape, said sponge being elongated along said center axis such that said sponge has an ovoid shape thereby facilitating said outer surface to conform to said outer wall of said shell when said sponge is positioned in said shell.

* * * * *